US011602832B2

(12) United States Patent
Bartoszek et al.

(10) Patent No.: US 11,602,832 B2
(45) Date of Patent: Mar. 14, 2023

(54) IMPACT TOOLS WITH RING GEAR ALIGNMENT FEATURES

(71) Applicant: Ingersoll-Rand Industrial U.S., Inc., Davidson, NC (US)

(72) Inventors: Jason Christopher Bartoszek, Bethlehem, PA (US); Joshua Odell Johnson, Allentown, PA (US); Douglas Fornell Leavitt, Bethlehem, PA (US); Thomas S. Dougherty, Mooresville, NC (US); Mark T. McClung, Andover, NJ (US); Sean C. Ely, Flemington, NJ (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 141 days.

(21) Appl. No.: 16/881,393

(22) Filed: May 22, 2020

(65) Prior Publication Data

US 2020/0282540 A1 Sep. 10, 2020

Related U.S. Application Data

(63) Continuation of application No. 15/172,420, filed on Jun. 3, 2016, now Pat. No. 10,668,614.

(Continued)

(51) Int. Cl.
*B25F 5/00* (2006.01)
*B25F 5/02* (2006.01)

(52) U.S. Cl.
CPC ..... *B25F 5/001* (2013.01); *B25F 5/02* (2013.01)

(58) Field of Classification Search
CPC . B25F 5/001; B25F 5/02; B25B 21/00; B25B 19/00
See application file for complete search history.

(56) References Cited

U.S. PATENT DOCUMENTS 1,495,153 A 5/1924 Benjamin
2,531,800 A 11/1950 Anderson
(Continued)

FOREIGN PATENT DOCUMENTS

CN 2650085 Y 10/2004
CN 1575218 A 2/2005
(Continued)

OTHER PUBLICATIONS

2145QiMax 3/4" Air Impactool "Maximum Impact"; Ingersoll-Rand, Aug. 26, 2014.

(Continued)

*Primary Examiner* — Daniel Jeremy Leeds
(74) *Attorney, Agent, or Firm* — Kevin E. West; Advent, LLP

(57) ABSTRACT

A hand-held power tool is provided that includes a housing, a motive source, a front endbell, an output shaft, a front housing, and a gear set assembly. The output shaft protrudes from an output end at the front endbell of the housing. The output shaft is also functionally coupled to the motive source such that the output shaft rotates in response to activation of the motive source when the motive source is supplied with power. The gear set assembly is located in an interior space of the front housing, and is configured to transfer rotation from the motive source to an output spindle. The gear set assembly also includes a ring gear that surrounds a portion of the output shaft and abuts the front endbell of the housing. A set of piloting features is provided that is configured to prevent movement of the ring gear relative to the motive source and the front housing, or the front housing relative to the housing.

19 Claims, 8 Drawing Sheets

Related U.S. Application Data

(60) Provisional application No. 62/171,741, filed on Jun. 5, 2015.

(56) References Cited

U.S. PATENT DOCUMENTS

| | | | |
|---|---|---|---|
| 2,543,979 | A | 3/1951 | Maurer |
| 2,637,825 | A | 5/1953 | Moore |
| 2,855,679 | A | 10/1958 | Gibble |
| 2,858,701 | A | 11/1958 | Willcox |
| 2,984,210 | A | 5/1961 | Fuehrer |
| 3,221,192 | A | 11/1965 | Franklin |
| 3,225,232 | A | 12/1965 | Turley et al. |
| 3,336,490 | A | 8/1967 | Yelpo et al. |
| 3,353,078 | A | 11/1967 | Maynard |
| 3,440,465 | A | 4/1969 | Pratt et al. |
| 3,451,492 | A | 6/1969 | Ekstrom et al. |
| 3,572,447 | A | 3/1971 | Pauley et al. |
| 3,578,091 | A | 5/1971 | States |
| 3,592,087 | A | 7/1971 | Pauley |
| 3,611,095 | A | 10/1971 | Schnizler |
| 3,643,749 | A | 2/1972 | Pauley |
| 3,703,933 | A | 11/1972 | Schoeps |
| 3,710,873 | A | 1/1973 | Allen |
| 3,741,313 | A | 6/1973 | States |
| 3,760,209 | A | 9/1973 | Hult |
| 3,835,934 | A | 9/1974 | Schoeps et al. |
| 3,894,254 | A | 7/1975 | Holther, Jr. |
| 3,908,766 | A | 9/1975 | Hess |
| 3,920,082 | A | 11/1975 | Dudek |
| 4,032,806 | A | 6/1977 | Seely |
| 4,156,821 | A | 5/1979 | Kurome et al. |
| 4,284,109 | A | 8/1981 | Kilmer et al. |
| 4,292,571 | A | 9/1981 | Cuneo |
| 4,307,325 | A | 12/1981 | Saar |
| 4,412,158 | A | 10/1983 | Jefferson et al. |
| 4,454,459 | A | 6/1984 | Huber |
| 4,506,743 | A | 3/1985 | Grossmann |
| 4,510,404 | A | 4/1985 | Barrett et al. |
| 4,513,381 | A | 4/1985 | Houser, Jr. et al. |
| 4,597,419 | A | 7/1986 | Galloup et al. |
| 4,661,756 | A | 4/1987 | Murphy et al. |
| 4,791,833 | A | 12/1988 | Sakai et al. |
| 4,838,361 | A | 6/1989 | O'Toole |
| 4,893,942 | A | 1/1990 | Stottmann |
| 4,978,877 | A | 12/1990 | Quirijnen |
| 4,991,472 | A | 2/1991 | Hollingsworth |
| 5,014,793 | A | 5/1991 | Germanton et al. |
| 5,105,130 | A | 4/1992 | Barker et al. |
| 5,138,243 | A | 8/1992 | Kress et al. |
| 5,200,658 | A | 4/1993 | Kohno et al. |
| 5,203,242 | A | 4/1993 | Hansson |
| 5,360,072 | A | 11/1994 | Lange |
| 5,365,155 | A | 11/1994 | Zimmermann |
| 5,473,519 | A | 12/1995 | McCallops et al. |
| 5,525,842 | A | 6/1996 | Leininger |
| 5,526,460 | A | 6/1996 | DeFrancesco et al. |
| 5,531,278 | A | 7/1996 | Lin |
| 5,561,734 | A | 10/1996 | Simonsen et al. |
| 5,712,543 | A | 1/1998 | Sjostrom |
| 5,714,815 | A | 2/1998 | Fritzinger et al. |
| 5,714,861 | A | 2/1998 | Hansen et al. |
| 5,738,177 | A | 4/1998 | Schell et al. |
| 5,804,936 | A | 9/1998 | Brodsky et al. |
| 5,897,454 | A | 4/1999 | Cannaliato |
| 5,992,257 | A | 11/1999 | Nemetz et al. |
| 5,998,897 | A | 12/1999 | Bosten et al. |
| 6,037,724 | A | 3/2000 | Buss et al. |
| 6,043,575 | A | 3/2000 | Ghode et al. |
| 6,318,189 | B1 | 11/2001 | Donaldson |
| 6,353,705 | B1 | 3/2002 | Capps et al. |
| 6,359,355 | B1 | 3/2002 | Hartsfield et al. |
| 6,424,799 | B1 | 7/2002 | Gilmore |
| 6,508,313 | B1 | 1/2003 | Carney et al. |
| 6,511,200 | B2 | 1/2003 | Matsunaga |
| 6,598,684 | B2 | 7/2003 | Watanabe |
| 6,607,041 | B2 | 8/2003 | Suzuki et al. |
| 6,691,796 | B1 | 2/2004 | Wu |
| 6,713,905 | B2 | 3/2004 | Hirschburger et al. |
| 6,725,945 | B2 | 4/2004 | Sugimoto et al. |
| 6,814,461 | B2 | 11/2004 | Minalga |
| 6,933,632 | B2 | 8/2005 | Braml et al. |
| 6,945,337 | B2 | 9/2005 | Kawai et al. |
| 6,948,647 | B1 | 9/2005 | Niblett et al. |
| 6,968,908 | B2 | 11/2005 | Tokunaga et al. |
| 6,988,897 | B2 | 1/2006 | Belongia et al. |
| 7,058,291 | B2 | 6/2006 | Weaver et al. |
| 7,090,032 | B2 | 8/2006 | Wada et al. |
| 7,109,675 | B2 | 9/2006 | Matsunaga et al. |
| 7,112,934 | B2 | 9/2006 | Gilmore |
| 7,152,329 | B2 | 12/2006 | Kondo et al. |
| 7,155,986 | B2 | 1/2007 | Kawai et al. |
| 7,201,235 | B2 | 4/2007 | Umemura et al. |
| 7,235,940 | B2 | 6/2007 | Bosch et al. |
| 7,236,243 | B2 | 6/2007 | Beecroft et al. |
| 7,237,622 | B2 | 7/2007 | Liao |
| 7,311,027 | B1 | 12/2007 | Tatsuno |
| 7,322,427 | B2 | 1/2008 | Shimma et al. |
| 7,331,406 | B2 | 2/2008 | Wottreng, Jr. et al. |
| 7,334,648 | B2 | 2/2008 | Arimura |
| 7,372,228 | B2 | 5/2008 | Hahn et al. |
| 7,397,153 | B2 | 7/2008 | Buck et al. |
| 7,398,834 | B2 | 7/2008 | Jung et al. |
| 7,419,013 | B2 | 9/2008 | Sainomoto et al. |
| 7,494,437 | B2 | 2/2009 | Chen |
| 7,578,357 | B2 | 8/2009 | Schell |
| 7,588,094 | B2 | 9/2009 | Lin |
| 7,600,577 | B2 | 10/2009 | Simm et al. |
| 7,607,493 | B2 | 10/2009 | Erhardt |
| 7,665,392 | B2 | 2/2010 | Tokunaga et al. |
| 7,677,752 | B2 | 3/2010 | Tadokoro et al. |
| 7,705,482 | B2 | 4/2010 | Leininger |
| 7,712,546 | B2 | 5/2010 | Tokunaga |
| 7,717,192 | B2 | 5/2010 | Schroeder et al. |
| 7,821,217 | B2 | 10/2010 | Abolhassani et al. |
| 7,839,112 | B2 | 11/2010 | Wei |
| 7,882,899 | B2 | 2/2011 | Borinato et al. |
| 7,928,615 | B2 | 4/2011 | Miyashita et al. |
| 7,942,211 | B2 | 5/2011 | Scrimshaw et al. |
| 7,980,320 | B2 | 7/2011 | Inagaki et al. |
| 8,016,048 | B2 | 9/2011 | Ueda et al. |
| 8,122,971 | B2 | 2/2012 | Whitmire et al. |
| 8,197,379 | B1 | 6/2012 | Yin |
| 8,210,275 | B2 | 7/2012 | Suzuki et al. |
| 8,267,924 | B2 | 9/2012 | Zemlok et al. |
| 8,294,399 | B2 | 10/2012 | Suzuki et al. |
| 8,303,449 | B2 | 11/2012 | Ho et al. |
| 8,316,958 | B2 | 11/2012 | Schell et al. |
| 8,317,350 | B2 | 11/2012 | Friedman et al. |
| 8,371,708 | B2 | 2/2013 | Nagasaka et al. |
| 8,381,830 | B2 | 2/2013 | Puzio et al. |
| 8,415,911 | B2 | 4/2013 | Lau et al. |
| 8,430,180 | B2 | 4/2013 | Gumpert et al. |
| 8,430,182 | B2 | 4/2013 | Soika et al. |
| 8,496,366 | B2 | 7/2013 | Leong |
| 8,511,399 | B2 | 8/2013 | Kunz |
| 8,528,658 | B2 | 9/2013 | Roehm et al. |
| 8,541,914 | B2 | 9/2013 | Knight et al. |
| 8,584,770 | B2 | 11/2013 | Zhang et al. |
| 8,593,020 | B2 | 11/2013 | Chun et al. |
| 8,607,893 | B2 | 12/2013 | Kumagai et al. |
| 8,636,081 | B2 | 1/2014 | Ludy et al. |
| 8,708,861 | B2 | 4/2014 | Inagaki et al. |
| 8,714,888 | B2 | 5/2014 | Bean et al. |
| 8,727,034 | B2 | 5/2014 | Leong et al. |
| 8,746,364 | B2 | 6/2014 | Atsumi et al. |
| 8,757,286 | B2 | 6/2014 | Nagasaka et al. |
| 8,800,679 | B2 | 8/2014 | Eshleman et al. |
| 8,820,430 | B2 | 9/2014 | Walker et al. |
| 8,939,228 | B2 | 1/2015 | Kondo |
| 9,089,954 | B2 | 7/2015 | Roehm |
| 9,193,055 | B2 | 11/2015 | Lim et al. |
| 9,217,492 | B2 | 12/2015 | Kierspe et al. |
| 9,321,156 | B2 | 4/2016 | Eshleman et al. |
| 9,385,352 | B2 | 7/2016 | Nguyen et al. |

(56) References Cited

U.S. PATENT DOCUMENTS 9,415,448 B2 8/2016 Schenk et al.
9,463,563 B2 10/2016 Takeuchi et al.
9,566,692 B2 2/2017 Seith et al.
9,579,785 B2 2/2017 Bixler et al.
9,739,366 B2 8/2017 Duerr
9,827,660 B2 11/2017 Blum et al.
9,950,417 B2 4/2018 Ito et al.
10,046,450 B2 8/2018 Bernhart et al.
10,052,733 B2 8/2018 Ely et al.
10,418,879 B2 9/2019 Bartoszek et al.
10,615,670 B2 4/2020 Madineni
2002/0001434 A1 1/2002 Kikinis
2002/0018474 A1 2/2002 Assa et al.
2002/0020538 A1 2/2002 Giardino
2002/0050364 A1 5/2002 Suzuki et al.
2002/0096342 A1 7/2002 Milbourne
2002/0108474 A1 8/2002 Adams
2002/0131267 A1 9/2002 Van Osenbruggen
2002/0172035 A1 11/2002 Hara et al.
2002/0185514 A1 12/2002 Adams et al.
2003/0002934 A1 1/2003 Hsu
2003/0121679 A1 7/2003 Taga
2003/0136570 A1 7/2003 Izumisawa et al.
2003/0149508 A1 8/2003 Watanabe
2004/0035495 A1 2/2004 Hessenberger et al.
2004/0211573 A1 10/2004 Carrier et al.
2005/0135084 A1 6/2005 Chen et al.
2005/0183870 A1 8/2005 Wada et al.
2005/0224242 A1 10/2005 Britz et al.
2005/0257945 A1 11/2005 Justis et al.
2005/0263304 A1 12/2005 Sainomoto et al.
2006/0012584 A1 1/2006 Vassallo et al.
2006/0071433 A1 4/2006 Miller
2006/0109246 A1 5/2006 Lee et al.
2006/0118314 A1 6/2006 Aeberhard et al.
2006/0125333 A1 6/2006 Wehner et al.
2006/0185869 A1 8/2006 Arimura
2006/0201612 A1 9/2006 Lin
2006/0226718 A1 10/2006 Yang
2006/0237205 A1 10/2006 Sia
2006/0243469 A1 11/2006 Webster
2007/0000676 A1 1/2007 Arimura
2007/0180959 A1 8/2007 Tokunaga et al.
2007/0193762 A1 8/2007 Arimura et al.
2007/0222310 A1 9/2007 Drexlmaier
2007/0256847 A1 11/2007 Wan et al.
2008/0000665 A1 1/2008 Kokinelis et al.
2008/0025017 A1 1/2008 Tadokoro et al.
2008/0032848 A1 2/2008 Ho
2008/0048650 A1 2/2008 Islam et al.
2008/0122302 A1 5/2008 Leininger
2009/0098971 A1 4/2009 Ho et al.
2009/0188688 A1 7/2009 Gumpert et al.
2009/0200053 A1 8/2009 Scrimshaw et al.
2009/0221222 A1 9/2009 Lo et al.
2009/0308624 A1 12/2009 Shibata et al.
2010/0163261 A1 7/2010 Tomayko et al.
2010/0175902 A1 7/2010 Rejman et al.
2010/0200380 A1 8/2010 Staas et al.
2010/0252287 A1 10/2010 Morimura et al.
2010/0263890 A1 10/2010 Profunser et al.
2010/0282482 A1 11/2010 Austin et al.
2010/0307782 A1 12/2010 Iwata et al.
2010/0326686 A1 12/2010 Leong et al.
2011/0000688 A1 1/2011 Iwata
2011/0024144 A1 2/2011 Usselman et al.
2011/0036605 A1* 2/2011 Leong ..... B25B 21/00 173/47
2011/0048750 A1 3/2011 Leong et al.
2011/0056715 A1 3/2011 Vanko et al.
2011/0079407 A1 4/2011 Iimura et al.
2011/0109093 A1 5/2011 Leininger
2011/0127059 A1 6/2011 Limberg et al.
2011/0132630 A1 6/2011 Kawamura et al.
2011/0147028 A1 6/2011 Iwashita et al.
2011/0147029 A1 6/2011 Roehm et al.
2011/0180290 A1 7/2011 Kondo
2011/0188232 A1 8/2011 Friedman et al.
2011/0203819 A1 8/2011 Tsai et al.
2011/0248650 A1 10/2011 Sterling et al.
2011/0284256 A1 11/2011 Iwata
2011/0308827 A1 12/2011 Kaufmann
2011/0315417 A1 12/2011 Matsunaga et al.
2012/0013829 A1 1/2012 Song et al.
2012/0055690 A1 3/2012 Uemura
2012/0132449 A1* 5/2012 Hecht ..... F16D 7/08 173/5
2012/0138329 A1 6/2012 Sun et al.
2012/0175142 A1 7/2012 Van Der Linde et al.
2012/0205131 A1 8/2012 Furusawa et al.
2012/0234568 A1 9/2012 Schnell et al.
2012/0273242 A1 11/2012 Eshleman et al.
2012/0279736 A1 11/2012 Tanimoto et al.
2012/0292071 A1 11/2012 Su et al.
2012/0292472 A1 11/2012 Segura et al.
2012/0318544 A1 12/2012 Sun et al.
2012/0318549 A1 12/2012 Nagasaka et al.
2013/0033217 A1 2/2013 Hirabayashi
2013/0056236 A1 3/2013 Morinishi et al.
2013/0062086 A1 3/2013 Ito et al.
2013/0062088 A1 3/2013 Mashiko et al.
2013/0062498 A1 3/2013 Ito et al.
2013/0068491 A1 3/2013 Kusakawa et al.
2013/0075121 A1* 3/2013 Nakamura ..... B25B 21/026 173/94
2013/0087355 A1 4/2013 Oomori et al.
2013/0105189 A1 5/2013 Murthy et al.
2013/0108385 A1 5/2013 Woelders
2013/0126202 A1 5/2013 Oomori et al.
2013/0133912 A1 5/2013 Mizuno et al.
2013/0153252 A1 6/2013 Sakakibara
2013/0153253 A1 6/2013 Ludy et al.
2013/0161040 A1 6/2013 Tomayko et al.
2013/0175066 A1 7/2013 Zhang et al.
2013/0186661 A1 7/2013 Okubo et al.
2013/0186666 A1 7/2013 Yoshino et al.
2013/0193891 A1 8/2013 Wood et al.
2013/0206434 A1 8/2013 Braun
2013/0206435 A1 8/2013 Papp
2013/0213680 A1 8/2013 Chen
2013/0220655 A1 8/2013 Tomayko
2013/0228353 A1 9/2013 Chen et al.
2013/0228356 A1 9/2013 Hayes et al.
2013/0240230 A1 9/2013 Saur
2013/0247706 A1 9/2013 Duerr
2013/0267374 A1 10/2013 Blum et al.
2013/0269961 A1 10/2013 Lim et al.
2013/0270932 A1 10/2013 Hatfield et al.
2013/0270934 A1 10/2013 Smith
2013/0274797 A1 10/2013 Nicholas et al.
2013/0284480 A1 10/2013 Horie et al.
2013/0292147 A1 11/2013 Mergener et al.
2013/0313925 A1 11/2013 Mergener et al.
2013/0327552 A1 12/2013 Lovelass et al.
2013/0333904 A1 12/2013 Raggl et al.
2013/0333910 A1 12/2013 Tanimoto et al.
2013/0342084 A1 12/2013 Su
2014/0026723 A1 1/2014 Persson et al.
2014/0036482 A1 2/2014 Vanko et al.
2014/0058390 A1 2/2014 Taylor et al.
2014/0069676 A1 3/2014 Abante et al.
2014/0096985 A1 4/2014 Chu et al.
2014/0100687 A1 4/2014 Ekstrom et al.
2014/0102741 A1 4/2014 Sekino et al.
2014/0138111 A1 5/2014 Takeuchi et al.
2014/0158390 A1 6/2014 Mashiko et al.
2014/0166326 A1 6/2014 Le Du et al.
2014/0182869 A1 7/2014 Kumagai et al.
2014/0182870 A1 7/2014 Herr
2014/0209342 A1 7/2014 Chen
2014/0290973 A1 10/2014 Lin
2014/0338503 A1 11/2014 Beer et al.
2014/0365012 A1 12/2014 Chen et al.
2014/0367134 A1 12/2014 Phillips et al.

(56) References Cited

U.S. PATENT DOCUMENTS

| | | | |
|---|---|---|---|
| 2015/0014010 | A1 | 1/2015 | Chang |
| 2015/0041163 | A1 | 2/2015 | McClung |
| 2015/0047866 | A1 | 2/2015 | Sakai et al. |
| 2015/0047943 | A1 | 2/2015 | Park |
| 2015/0122521 | A1 | 5/2015 | Chen et al. |
| 2015/0122523 | A1 | 5/2015 | Yamamoto et al. |
| 2015/0122524 | A1 | 5/2015 | Papp |
| 2015/0129248 | A1 | 5/2015 | Nitsche et al. |
| 2015/0136433 | A1 | 5/2015 | Nitsche et al. |
| 2015/0144365 | A1 | 5/2015 | Hirabayashi et al. |
| 2015/0151424 | A1 | 6/2015 | Elder et al. |
| 2015/0171654 | A1 | 6/2015 | Horie et al. |
| 2015/0197003 | A1 | 7/2015 | Lin et al. |
| 2015/0202759 | A1 | 7/2015 | Wang |
| 2015/0209948 | A1 | 7/2015 | Hecht et al. |
| 2015/0328760 | A1 | 11/2015 | Ikuta et al. |
| 2015/0336249 | A1 | 11/2015 | Iwata et al. |
| 2016/0102762 | A1 | 4/2016 | Brennenstuhl et al. |
| 2016/0131353 | A1 | 5/2016 | Bartoszek |
| 2016/0176027 | A1 | 6/2016 | Aoyagi |
| 2016/0250738 | A1 | 9/2016 | Leh et al. |
| 2016/0311094 | A1 | 10/2016 | Mergener et al. |
| 2016/0354889 | A1 | 12/2016 | Ely et al. |
| 2016/0354905 | A1 | 12/2016 | Ely et al. |
| 2016/0354915 | A1 | 12/2016 | Bartoszek et al. |
| 2017/0225309 | A1 | 8/2017 | Meyer |
| 2018/0161951 | A1 | 6/2018 | Billings et al. |

FOREIGN PATENT DOCUMENTS

| | | | |
|---|---|---|---|
| CN | 1583370 | A | 2/2005 |
| CN | 101253015 | A | 8/2008 |
| CN | 103481251 | A | 1/2014 |
| CN | 103989497 | A | 8/2014 |
| CN | 104162880 | A | 11/2014 |
| CN | 104676315 | A | 6/2015 |
| DE | 19518591 | A1 | 12/1996 |
| DE | 102004051913 | A1 | 2/2006 |
| DE | 202006018761 | U1 | 2/2007 |
| DE | 102006000543 | A1 | 6/2008 |
| DE | 102008020173 | A1 | 10/2009 |
| DE | 102012211914 | A1 | 10/2013 |
| DE | 202016104126 | U1 | 8/2016 |
| EP | 0271903 | A2 | 6/1988 |
| EP | 0585541 | A2 | 3/1994 |
| EP | 0585541 | A3 | 11/1994 |
| EP | 0585541 | B1 | 9/1997 |
| EP | 0911119 | A2 | 4/1999 |
| EP | 1426989 | A1 | 6/2004 |
| EP | 1524085 | A2 | 4/2005 |
| EP | 1595649 | A2 | 11/2005 |
| EP | 1595650 | A2 | 11/2005 |
| EP | 1867438 | A2 | 12/2007 |
| EP | 1943061 | A2 | 7/2008 |
| EP | 1982798 | A2 | 10/2008 |
| EP | 1207016 | B1 | 1/2009 |
| EP | 2042271 | A2 | 4/2009 |
| EP | 2062670 | A2 | 5/2009 |
| EP | 2062700 | A2 | 5/2009 |
| EP | 1524084 | B1 | 8/2009 |
| EP | 2075094 | B1 | 2/2011 |
| EP | 1447177 | B1 | 4/2011 |
| EP | 2256899 | B1 | 8/2011 |
| EP | 2184138 | A3 | 12/2011 |
| EP | 2524775 | A2 | 11/2012 |
| EP | 2535150 | A2 | 12/2012 |
| EP | 2687338 | A1 | 1/2014 |
| GB | 752251 | A | 7/1956 |
| GB | 1068990 | A | 5/1967 |
| GB | 1413293 | A | 11/1975 |
| GB | 2396390 | A | 6/2004 |
| GB | 2514261 | A | 11/2014 |
| JP | H08193896 | A | 7/1996 |
| JP | H08294878 | A | 11/1996 |
| JP | 2000218561 | A | 8/2000 |
| JP | 2002331427 | A | 11/2002 |
| JP | 2004202600 | A | 7/2004 |
| JP | 2004239681 | A | 8/2004 |
| JP | 2005254400 | A | 9/2005 |
| JP | 2006272488 | A | 10/2006 |
| JP | 2006312210 | A | 11/2006 |
| JP | 2009269137 | A | 11/2009 |
| JP | 2010012585 | A | 1/2010 |
| JP | 2011031369 | A | 2/2011 |
| JP | 2011067910 | A | 4/2011 |
| JP | 2011230272 | A | 11/2011 |
| JP | 2012035358 | A | 2/2012 |
| JP | 2012149669 | A | 8/2012 |
| RU | 2360786 | C2 | 7/2009 |
| TW | 201231843 | A | 8/2012 |
| WO | 9853959 | A1 | 12/1998 |
| WO | 0064639 | A1 | 11/2000 |
| WO | 0144776 | A1 | 6/2001 |
| WO | 0154865 | A2 | 8/2001 |
| WO | 0230624 | A2 | 4/2002 |
| WO | 02058891 | A1 | 8/2002 |
| WO | 2004029569 | A1 | 4/2004 |
| WO | 2009011633 | A1 | 1/2009 |
| WO | 2010110716 | A1 | 9/2010 |
| WO | 2011013852 | A1 | 2/2011 |
| WO | 2011099487 | A1 | 8/2011 |
| WO | 2011102559 | A1 | 8/2011 |
| WO | 2012002578 | A1 | 1/2012 |
| WO | 2012023452 | A1 | 2/2012 |
| WO | 2013037325 | A1 | 3/2013 |
| WO | 2013164905 | A1 | 11/2013 |
| WO | 2013183535 | A1 | 12/2013 |
| WO | 2014098256 | A1 | 6/2014 |
| WO | 2014108110 | A1 | 7/2014 |
| WO | 2014124859 | A1 | 8/2014 |
| WO | 2016196899 | A1 | 12/2016 |

OTHER PUBLICATIONS

3W Portable Rechargeable LED Work Light with Magnetic Base Power Car Charger, from: http://www.ebay.com/itm/like/141277021128?1pid=82; dated Sep. 10, 2014.

Ac85-265v Or Dcl2v/24v Epistar Cob Led Chip Led Work Flashlight, from: http://www.alibaba.com/product-detail!AC85-265v-or-dc 12v-24v-epistar _ 1450867344.html ; dated Sep. 10, 2014.

Ace LED Work Light with Stand; Retrieved on Sep. 2, 2014 from: http://www.acehardware.com/product/index.jsp?productid=19607576; dated Sep. 2, 2014.

"Air Impact Wrench 588A1 Maintenance Information"; Ingersoll-Rand, Nov. 1, 2007.

ATD 80304 Saber 3Watt Cob LED Strip Light Plus 2.4watt Top Light, from: https://www.google.com/shopping/product/3819105557822370488?q=COB+LED+flashlight&espv=2&biw=1680&bih=949&bav=on.2; dated Sep. 10, 2014.

ATD Tools 80335 35W Cob LED Worklight w/Stand, from: https://www.google.com/shopping/product/16993246027546592360?q=COB+LED+flashlight&espv=2&biw=1680&bih=949&bav=on.2; dated Sep. 10, 2014.

ClipStrip™ Aqua—Waterproof & Rechargeable LED Strip Light, from: http://www.cliplight.com/automotive/lighting/compact-series/clipstrip-aqu a/; Dated Sep. 10, 2014.

Cn I 04676315 Dated Jun. 3, 2015, Chou; English Translation.

Dial a Speed; Taken from the Internet on Aug. 29, 2014 from http://makezine.com/projects/the-dial-a-speed/.

Examination Report for European Application No. 16804498.8, dated May 29, 2019.

Examination Report for European Application No. 16804555.7, dated Feb. 2, 2021.

Extended European Search Report for European Application 16804509.4, dated Feb. 20, 2019.

Extended European Search Report for European Application No. 16804498.0, dated Sep. 25, 2018.

Extended European Search Report for European Application No. 16804555.7, dated May 13, 2019 (Date completed May 2, 2019).

(56) References Cited

OTHER PUBLICATIONS

Extended European Search Report for European Application No. EP 16804517.7, dated Dec. 4, 2018.
Festool RO 90 DX; Taken from the Internet on Aug. 29, 2014 from http://www.thewoodnerd.com/reviews/festoolR090DX.html.
Hot Sell High Brightness Cob Flashlight, from http://www.alibaba.com/product-detail!Hot-sell-high-brightn ess-COB-Flashlight_I850789033.html; dated Sep. 10, 2014.
International Search Report and Written Opinion for PCT/US2016/035665, dated Aug. 26, 2016.
International Search Report and Written Opinion for PCT/US2016/035681, dated Sep. 6, 2016.
International Search Report and Written Opinion for PCT/US2016/035698, dated Aug. 31, 2016.
International Search Report and Written Opinion for PCT/US2016/035797, dated Sep. 2, 2016.
International Search Report and Written Opinion for PCT/US2016/035807, dated Oct. 7, 2020.
International Search Report for PCT/US2016/035674, dated Sep. 14, 2016.
Jimmy Houston Folding Flip Light; Retrieved on Sep. 2, 2014 from: http://www.walmart.com/ip/20512279?wmlspartner=wlpa&adid=22222222227014895251&wIO=&wll=g8wl2=c&wl3=409695349528w14=&wl5=pla&wl6=78912422192&veh=sem#ProductDetail; dated Sep. 2, 2014.
Laser-Flex 2D by Penn Tool Co.; Retrieved on Sep. 2, 2014 from: http://www.penntoolco.com/catalog/products/products.cfm?categoryID=1351; dated Sep. 2, 2014.
"Life Box Series by Streamlight"; Retrieved on Sep. 2, 2014 from: http://www.streamlight.com/en-ca/product/class.html?cid=6; dated Sep. 2, 2014.
Makita Flashlight, ML140, 14.4V, from http://www.globalindustrial.com/p/tools/portable-worklights/Flashlights-Handheld/flashlight-ml140-144 v; dated Sep. 10, 2014.
Office Action for Chinese Application No. 201680031397.8, dated Dec. 5, 2018.
Office Action for Chinese Application No. 201680031488.1, dated Dec. 11, 2018.
Office Action for Chinese Application No. 201680031710.8, dated Dec. 18, 2018.
Office Action for Chinese Application No. 201680031738.1, dated Dec. 18, 2018.
Office Action for Chinese Patent Application No. 201680031739.6, dated Nov. 20, 2020.
Office Action for Chinese Patent Application No. 201680031740.9, dated Nov. 23, 2020.
Partial Supplementary European Search Report for European Application No. 16804555.7, dated Jan. 18, 2019 (Search completed Jan. 9, 2019).
PELICAN Remote Area Lighting; Retrieved on Sep. 2, 2014 from: http://www.grainger.com/product/PELICAN-Remote-Area-Lighting-System-5RZY8?s_pp=false&picUrl=//static.grainger.com/rp/s/is/image/Grainger/5RZY8ASO1?$smthumb$; dated Sep. 2, 2014.
Supplemental European Search Report for European Application No. 16804550, dated Dec. 19, 2018.
Supplementary European Search Report for European Application No. 16804505, dated Jan. 28, 2018.
SYCLONE by Streamlight; Retrieved on Sep. 2, 2014 from http://www.smokesign.com/syrefl.html; dated Sep. 2, 2014.
Zoro LED Worklight by Cooper; Retrieved on Sep. 2, 2014 from: http://www.zoro.com/i/G4585287/?utm_source=google_shopping&utm_medium=cpc&utm_campaign=Google_Shopping_Feed&gclid=CPm46JHwwsACFRMLMgod_H8AyA; dated Sep. 2, 2014.

* cited by examiner

IMPACT TOOLS WITH RING GEAR ALIGNMENT FEATURES

RELATED APPLICATIONS

The present application relates to and claims priority to U.S. Provisional Patent Application, Ser. No. 62/171,741, filed on Jun. 5, 2015, entitled "Impact Tools with Ring Gear Alignment Features." The subject matter disclosed in that provisional application is hereby expressly incorporated into the present application.

TECHNICAL FIELD AND SUMMARY

The present disclosure relates, generally, to power tools and, more particularly, to impact tools including a ring gear alignment feature.

Many power tools include gear assemblies configured to translate rotational forces produced by a motor into rotation of an output spindle of the power tool. In such power tools, it is generally desirable to have the positions of the motor and the gear assembly fixed relative to one another for proper operation of the power tool. It would, therefore, be beneficial to have certain features on the power tool include piloting features to assist assembling certain structures and keep them fixed relative to other structures.

To that end, an illustrative embodiment of the present disclosure provides a hand-held power tool which comprises a housing, a motive source, a front endbell, an output shaft, a front housing, a gear set assembly, a first set of piloting features, and a second set of piloting features. The housing supports the motive source and includes a front endbell. The output shaft protrudes from an output end at the front endbell of the housing. The output shaft is also functionally coupled to the motive source such that the output shaft rotates in response to activation of the motive source when the motive source is supplied with power. The front housing defines an interior space. The output shaft is located in the interior space of the front housing. The gear set assembly is located in the interior space of the front housing, and is configured to transfer rotation from the motive source to an output spindle. The gear set assembly also includes a ring gear characterized by an annular ring body having a plurality of teeth located on the interior periphery of the annular ring body and a surface located on an exterior periphery of the annular ring body opposite the interior periphery. The ring gear surrounds a portion of the output shaft and abuts the front endbell of the housing. The surface of the exterior periphery of the ring gear abuts an interior surface of the front housing. The first set of piloting features is located on the interior surface of the front housing and on the surface of the exterior periphery of the ring gear, and is configured to prevent movement of the ring gear relative to the motive source and the front housing. The second set of piloting features is located on the front housing and on the endbell of the housing, and is configured to prevent the front housing from moving relative to the housing.

In the above and other embodiments of the present disclosure may also comprise: the front housing being a hammer case; the impact mechanism being supported in the hammer case; the front housing being attached to the housing with fasteners; the gear set assembly including a planetary gear set; the first set of piloting features further comprise one or more grooves formed in the interior surface of the front housing, and one or more corresponding ridges formed on the surface of the exterior periphery of the annular ring body of the ring gear, wherein the one or more grooves are configured to receive the one or more corresponding ridges to prevent movement between the front housing and the ring gear; the first set of piloting features having one or more grooves formed in the surface of the exterior periphery of the annular ring body of the ring gear, and one or more corresponding ridges formed on the interior surface of the front housing, wherein the one or more grooves are configured to receive the one or more corresponding ridges to prevent movement between the front housing and the ring gear; the second set of piloting features having one or more corresponding ridges formed on an outer surface of the front endbell of the housing, wherein each of the one or more grooves of the front housing is sized to receive both a corresponding ridge formed on the surface of the exterior periphery of the annular ring body of the ring gear and the one or more corresponding ridges formed on an outer surface of the front endbell, wherein each of the one or more grooves extends axially along the interior surface of the front housing; dimensions of each of the one or more ridges formed on the surface of the exterior periphery of the annular ring body of the ring gear are substantially similar to dimensions of each of the one or more corresponding ridges formed on the outer surface of the front endbell; the interior surface of the front housing defines an inner diameter of the outer periphery of the ring body of the ring gear and an outer diameter of the front endbell; the one or more grooves of the front housing align with the one or more ridges formed on the surface of the exterior periphery of the annular ring body of the ring gear and the one or more corresponding ridges formed on the outer surface to advance the front housing axially along a central axis toward the housing to engage and secure to the housing; the one or more grooves of the front housing include a flange surface configured to clamp the ring gear against the front endbell when the front housing is secured to the housing; the first set of piloting features further comprise one or more ridges formed on the front housing and one or more corresponding grooves formed on the surface of the outer periphery of the ring gear and the one or more corresponding grooves formed on the front endbell; the front endbell being configured to surround at least a portion of the ring gear to align and secure the ring gear in relation to the motive source, wherein the front housing is configured to operatively couple the housing, the front endbell, and the ring gear together the front endbell including an annular flange formed in a front end of the front endbell, wherein the annular flange includes an inner surface configured to from a cavity sized to receive a portion of the ring gear, the inner surface of the annular flange of the endbell operatively couples to an outer surface of the ring gear when the ring gear to prevent the ring gear from rotating during normal operation; the front housing is configured to be secured to the outer surface of the housing, wherein the front housing includes a housing flange and a gear assembly surface, wherein the housing flange is configured to operatively couple to the outer surface of the housing to secure the front housing to tool housing, and wherein the gear assembly surface is configured to abut the annular flange of the front endbell and the ring gear so the front housing cooperates with the front endbell to hold the ring gear, the first set of piloting features including the ring gear insert molded to the front endbell, wherein the front housing is operatively coupled to the ring gear, the front endbell, and wherein front housing includes a nose piece located adjacent the output spindle; the front housing including a tapered section and a flange, wherein the tapered section of the front housing is configured to operatively couple to an inner surface of the housing, and wherein the flange is configured to operatively couple to outer surfaces of the ring gear; the ring gear including a lip formed on an interior portion of the ring gear, wherein the lip is configured to cooperate with the front endbell; the ring gear being secured to the front endbell, wherein securement features are formed on the ring gear which are filled with a plastic material that holds the ring gear to the front endbell, wherein the securement features are selected from the group consisting of at least one raised structure and one or more recess; the ring gear being secured to the front endbell, and wherein the hand-held power tool neither comprises securement features that include one or more fasteners engage fastener guide bores formed in the front endbell and are configured to align with corresponding fastener guide bores formed in the ring gear; and the ring gear being molded into part of the front housing.

Another illustrative embodiment of the present disclosure provides a hand-held power tool which comprises a housing, a motive source, a front endbell, an output shaft, a front housing, and a gear set assembly. The housing supports motive source, and includes the front endbell. The output shaft protrudes from an output end at the front endbell of the housing, and is functionally coupled to the motive source such that the output shaft rotates in response to activation of the motive source when the motive source is supplied with power. The front housing defines an interior space, and the output shaft is located in that interior space. The gear set assembly is located in the interior space of the front housing, and is configured to transfer rotation from the motive source to an output spindle. The gear set assembly also includes a ring gear characterized by an annular ring body having a plurality of teeth located on the interior periphery of the annular ring body and a surface located on an exterior periphery of the annular ring body opposite the interior periphery. The ring gear surrounds a portion of the output shaft and abuts the front endbell of the housing. The front housing and ring gear further include one or more piloting features, each of the one or more piloting features being configured to mate the front housing with the ring gear.

In the above and other embodiments of the present disclosure may also comprise: one or more piloting features configured to mate the front housing with the front endbell; the one or more piloting features including one or more grooves formed in an interior surface of the front housing, and one or more corresponding ridges formed on a surface of an exterior periphery of the ring gear, wherein the one or more grooves are configured to receive the one or more corresponding ridges to prevent movement between the front housing and the ring gear, the one or more piloting features further comprise one or more grooves formed in the surface of the exterior periphery of the ring gear, and one or more corresponding ridges formed on the interior surface of the front housing, wherein the one or more grooves are configured to receive the one or more corresponding ridges to prevent movement between the front housing and the ring gear.

Another illustrative embodiment of the present disclosure provides a hand-held power tool which comprises a housing, a motive source, a front endbell, an output shaft, a front housing, and a gear set assembly. The housing supports the motive source. The housing includes the front endbell. The output shaft protrudes from an output end at the front endbell of the housing, and is functionally coupled to the motive source such that the output shaft rotates in response to activation of the motive source when the motive source is supplied with power. The front housing defines an interior space, and the output shaft is located in that interior space. The gear set assembly is located in the interior space of the front housing, and is configured to transfer rotation from the motive source to an output spindle. The gear set assembly also includes a ring gear characterized by an annular ring body having a plurality of teeth located on the interior periphery of the annular ring body, and a surface located on an exterior periphery of the annular ring body opposite the interior periphery. The ring gear surrounds a portion of the output shaft and abuts the front endbell of the housing. The ring gear is inserted molded into the front endbell of the housing such that ring gear is restrained against both axial and rotational movement relative to the front endbell.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels may be repeated among the figures to indicate corresponding or analogous elements.

DETAILED DESCRIPTION OF THE DRAWINGS

Figure 1:
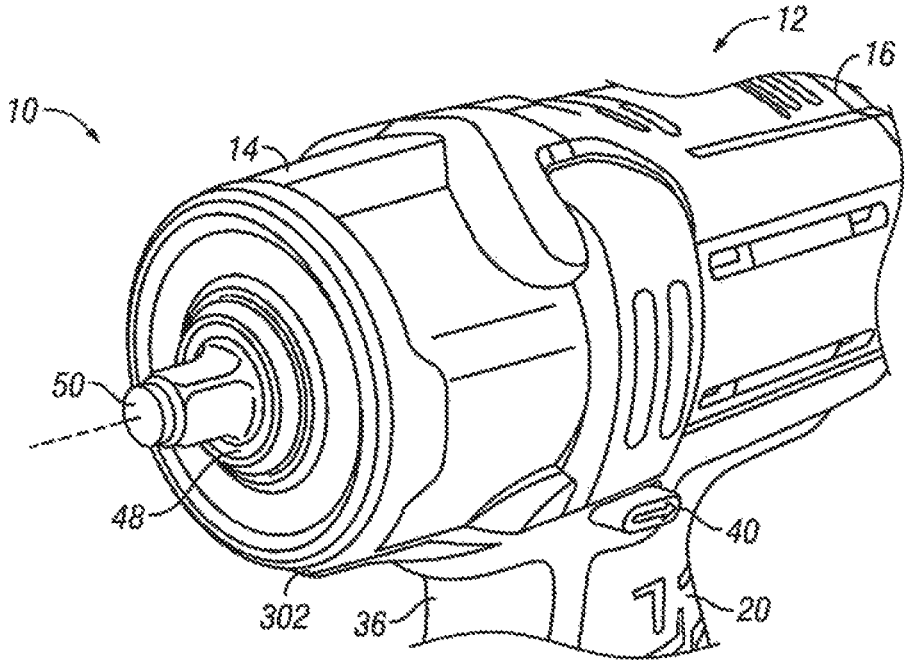
FIG. 1 is perspective view of an illustrative power tool.
Figure 2:
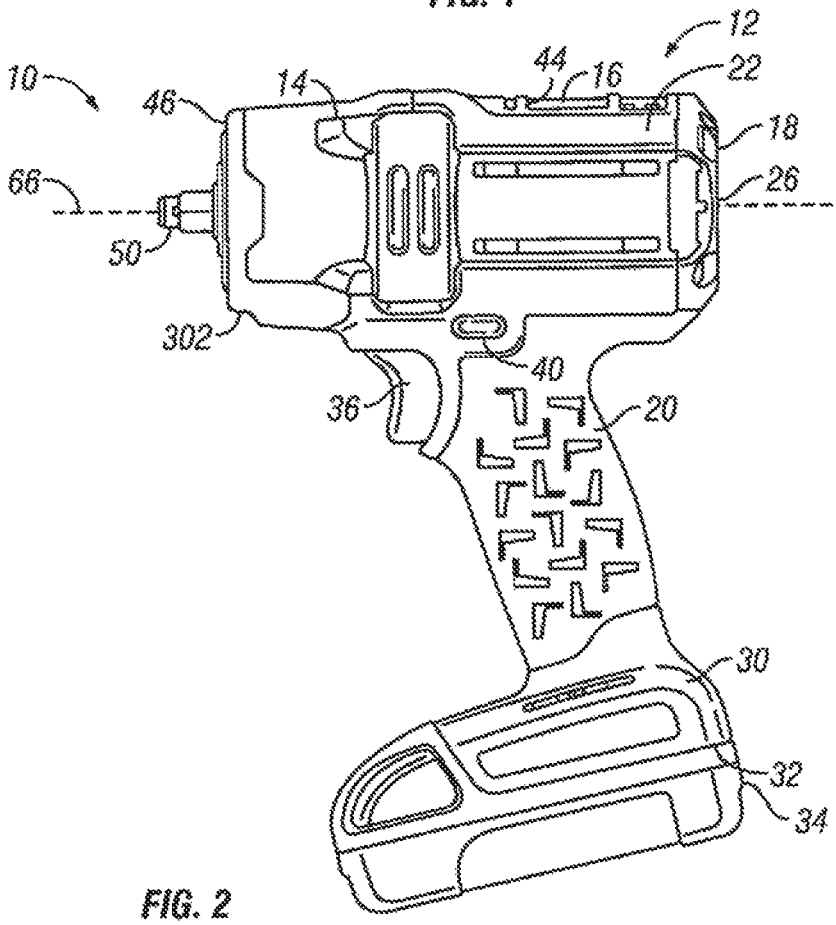
FIG. 2 is a side elevation view of the power tool of FIG. 1.
Figure 3:
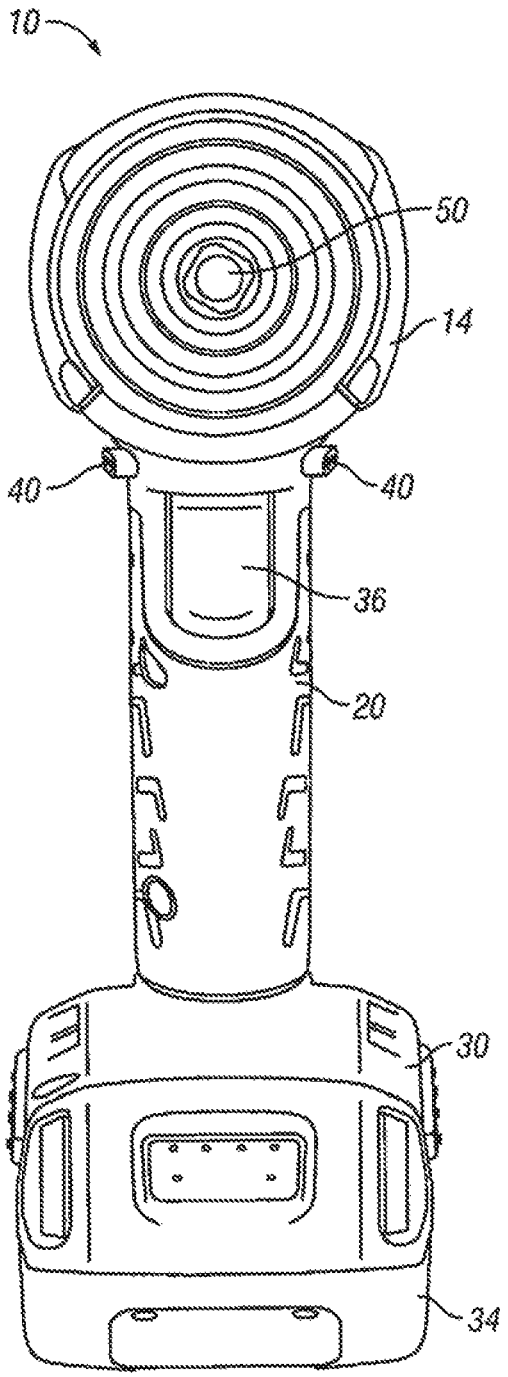
FIG. 3 is a front elevation view of the power tool of FIG. 1.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Referring now to FIGS. 1-4, an illustrative power tool 10 is shown. The power tool 10 is illustratively embodied as a cordless, electric power tool. In particular, the power tool 10 is shown in FIG. 1 as a pistol-grip style cordless electric impact tool, which includes an impact mechanism in-line with an output of the tool 10. It should be appreciated, however, that in other embodiments, the power tool 10 may be embodied as another type of impact tool, such as an angle impact tool in which the output of the tool 10 is disposed at an angle (e.g., a right angle) to the impact mechanism. It is appreciated that power tool 10 may include a native source such as a motor including an electric motor, or a pneumatic motor, for example.

The illustrative power tool 10 includes a tool housing 12 and a hammer case 14 as shown in FIG. 1. The tool housing 12 defines a body 16, a back cap 18, and a handle 20. The body 16 defines an interior space 22 in which a motor assembly 24 of the tool 10 is positioned. It is appreciated that motor assembly 24 may include a motive source such as an electric motor (either corded or cordless), air, or other fluid motor. The back cap 18 is coupled to the body 16 when the tool 10 is assembled to close off the interior space 22 and define a back end 26 that is positioned opposite the hammer case 14 of the tool 10. The back cap 18 is coupled to the body 16 using fasteners 28 (best seen in FIG. 4) that extend through the back cap 18 and into the motor assembly 24 (see FIGS. 5, 7, and 8).

In the illustrative embodiment, the handle 20 of the tool housing 12 extends away from the body 16 and is configured to be graspable by a user of the tool 10. A power source connection 30 is positioned at an end 32 of the handle 20 opposite the body 16. The power source connection 30 may be configured to connect to any source of power, such as, for example, a battery, a source of motive fluid, or an outlet connected to an electrical grid. In the illustrative embodiment, a power source 34 of the power tool 10 is a battery attached to the power source connection 30.

Figure 4:
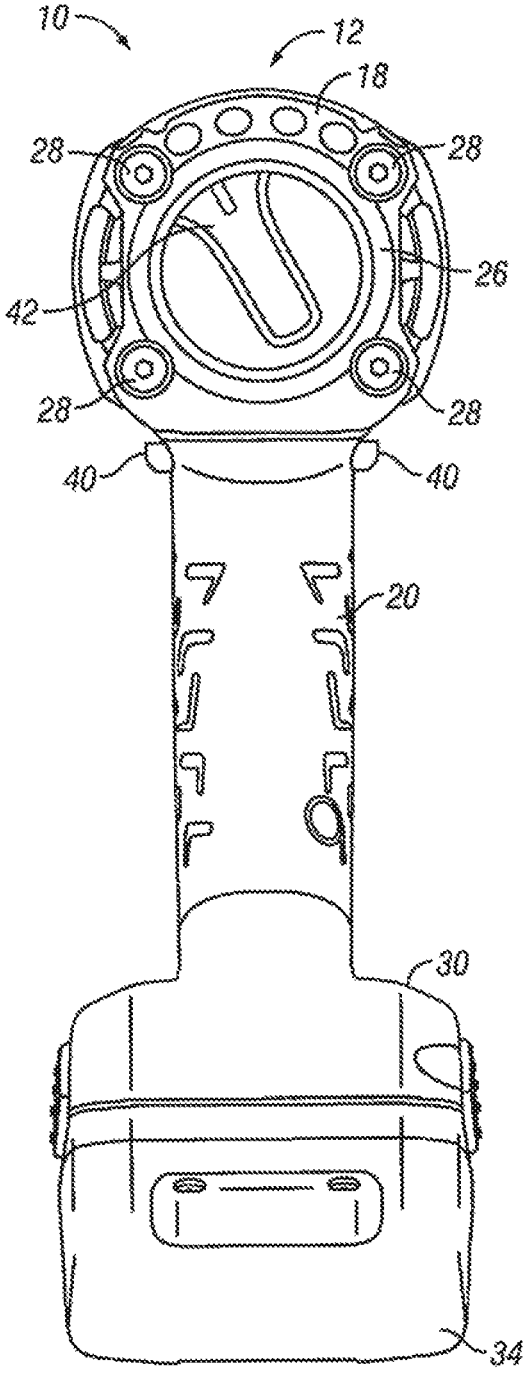
FIG. 4 is a rear elevation view of the power tool of FIG. 1.

The tool 10 includes a number of user-selectable input devices, which may be embodied as triggers, switches, or knobs configured to allow the user to adjust one or more features of the power tool 10. For example, the handle 20 includes trigger 36 configured to, among other things, turn an electric motor 38 (see FIG. 6) on/off in use of the tool 10. A Forward/Neutral/Reverse ("F/N/R") switch 40 is positioned in the handle 20 near the body 16 and the trigger 36. The F/N/R switch 40, among other things, is configured to control the direction of rotation of the motor 38. A control knob 42 is positioned on the back cap 18 of the tool 10 (as best seen in FIG. 4) and is configured to adjust the mode of operation of the power tool 10.

The hammer case 14 is positioned on the body 16 of the tool housing 12 opposite the back cap 18. The hammer case 14 includes a tool end 44 configured to couple to the tool housing 12 and an output end 46 that includes an aperture 48 through which an output spindle 50 of the tool 10 protrudes. The hammer case 14 defines an interior space 52 in which a gear assembly 54 and an impact mechanism (not shown) are housed. In the illustrative embodiment, the hammer case 14 is removably coupled to the tool housing 12 through one or more fasteners (not shown). In other embodiments, the hammer case 14 may be removably coupled to the tool housing 12 via other mechanisms (e.g., a snap fit).

Figure 5:
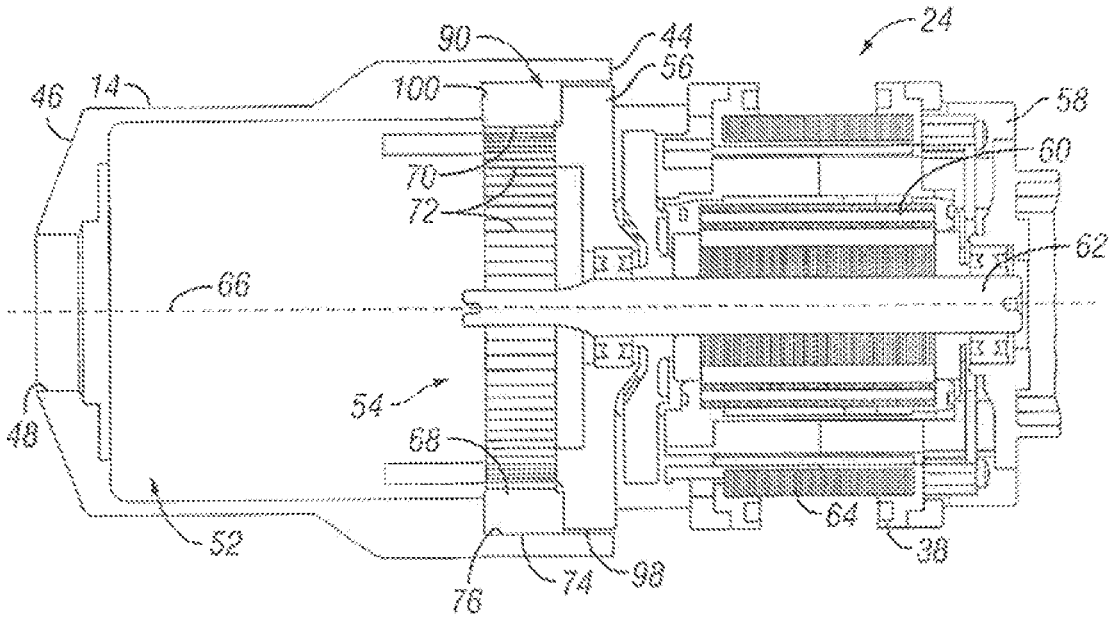
FIG. 5 is a cross-section view of a motor assembly, a hammer case, and a ring gear of the power tool of FIG. 1.
Figure 6:
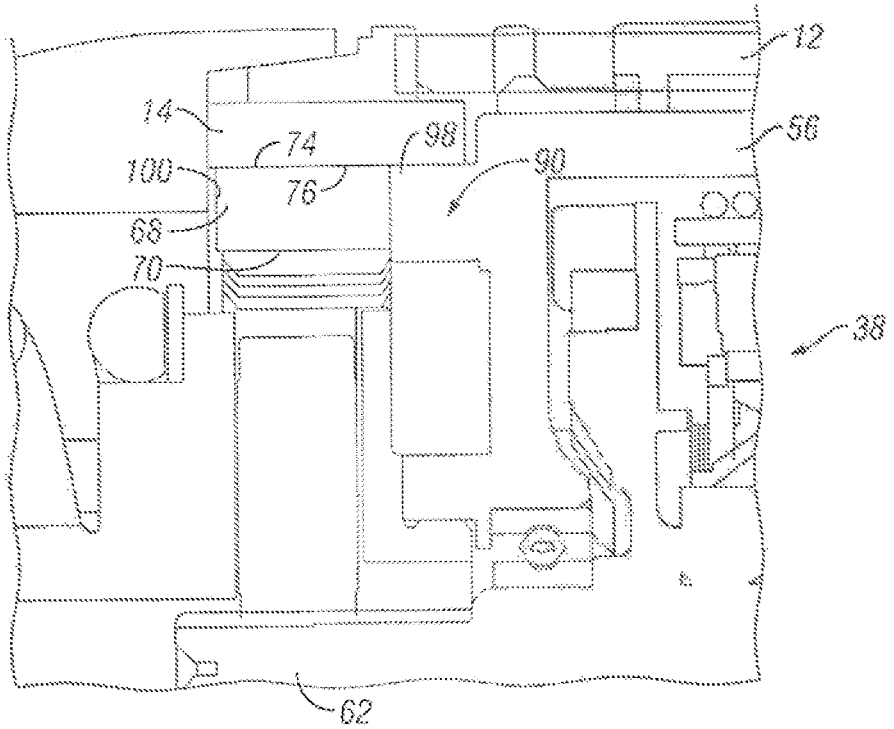
FIG. 6 is a magnified cross-section view the interfaces between the motor assembly, the hammer case, and the ring gear of the power tool of FIG. 1.

Referring now to FIGS. 5 and 6, the motor assembly 24 includes the electric motor 38, a front endbell 56, and a rear endbell 58. The electric motor 38 is illustratively embodied as a brushless DC electric motor. The electric motor 38 includes a rotor 60 configured to drive an output shaft 62 to output mechanical power and a stationary component (i.e., a stator) 64 that extends around the rotor 60. The output shaft 62 is functionally coupled to the output spindle 50 via the gear assembly 54.

Figure 7:
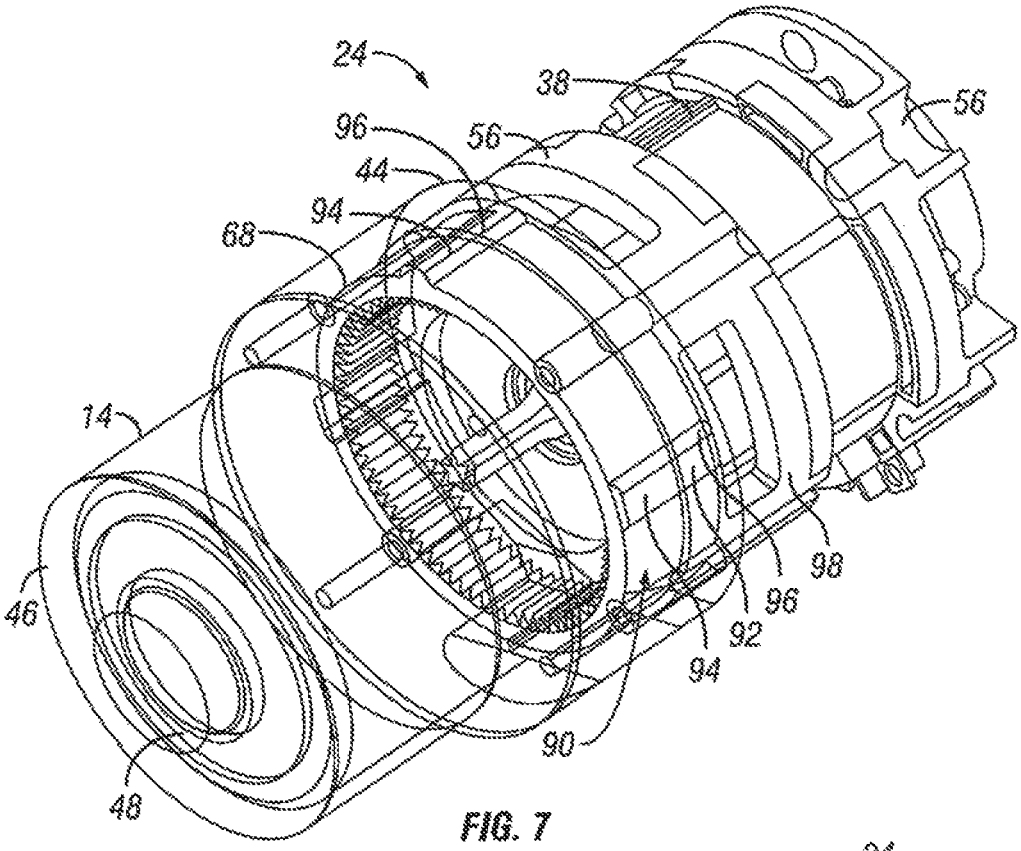
FIG. 7 is a perspective view of the motor assembly, the hammer case, and the ring gear of the power tool of FIG. 1.
Figure 8:
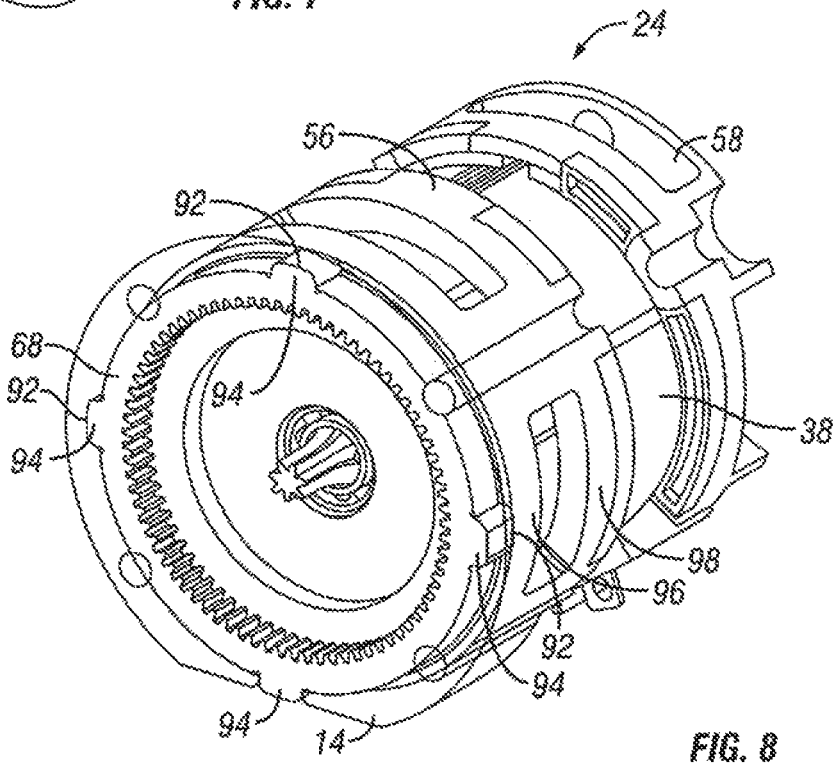
FIG. 8 is a cut-away perspective view of the motor assembly, the hammer case, and the ring gear of the power tool of FIG. 1.

The rear endbell 58 is positioned in the interior space 22 to be near the back cap 18 and the front endbell 56 is positioned such that it is enclosed in the interior space 22 of the tool housing 12 and the interior space 52 of the hammer case 14 (as best seen in FIG. 7). The rotor 60 and the stator 64 of the motor 38 are positioned between the two endbells 56, 58. The front endbell 56 and the rear endbell 58 cooperate to align the rotor 60 and the stator 64 so that the rotor 60 and the stator 64 extend parallel to a central axis 66 of the motor 38.

The illustrative gear assembly 54 may be embodied as, or include, a planetary gear set that is configured to transfer rotation of the output shaft 62 of the motor 38 to an impact mechanism of the tool 10 housed in the hammer case 14. The gear assembly 54 includes a ring gear 68 positioned in the interior space 52 of the hammer case 14. The ring gear 68 surrounds the output shaft 62 and abuts the front endbell 56. The ring gear 68 is formed as an annular ring with an inner surface 70 that includes a plurality of gear teeth 72 and an outer surface 74 configured to abut an inner surface 76 of the hammer case 14.

Referring now to FIGS. 5-8, piloting features 90 are integrated into the hammer case 14, the front endbell 56, and the ring gear 68. The piloting features 90 are configured to align the hammer case 14, the front endbell 56, and the ring gear 68 with one another. The piloting features 90 are also configured to prevent rotation of the ring gear 68 relative to the motor assembly 24 and the hammer case 14.

In the illustrative embodiment, the piloting features 90 include one or more grooves 92 formed in the inner surface 76 of the hammer case 14, one or more corresponding ridges 94 formed on the outer surface 74 of the ring gear 68, and one or more corresponding ridges 96 formed on an outer surface 98 of the front endbell 56. Each groove 92 is sized to receive both a corresponding ridge 94 and a corresponding ridge 96. Each groove 92 extends axially along the inner surface 76 of the hammer case 14 from the tool end 44. In the illustrative embodiment, the dimensions of each ridge 94 are approximately the same as the dimensions of each corresponding ridge 96. Each ridge 94 is positioned along the outer surface 74 of the ring gear 68 and each ridge 96 is positioned along the outer surface 98 of the front endbell 56. In the illustrative embodiment, both sets of ridges 94, 96 are spaced evenly around the outer surfaces of their respective structures, the ring gear 68 and the front endbell 56. The hammer case 14 defines an inner diameter that is sized to match an outer diameter of the ring gear 68 and an outer diameter of the front endbell 56. Although tool 10 is illustratively shown as including four grooves 92, four ridges 94, and four ridges 96, it will be appreciated that the tool 10 may include any number of grooves 92, corresponding ridges 94, and corresponding ridges 96 in other embodiments.

When assembling the tool 10, the user aligns the ridges 94 with corresponding ridges 96, aligns the grooves 92 of the hammer case 14 with the now aligned ridges 94, 96, and advances the hammer case 14 axially along the central axis 66 toward the tool housing 12 until the tool end 44 of the hammer case 14 contacts the tool housing 12. As the hammer case 14 is advanced along the central axis 66, the grooves 92 first pass over the ridges 94 and then pass over the ridges 96.

The piloting features 90 are configured to secure the ring gear 68 relative to the front endbell 56 such that the ring gear 68 cannot rotate relative to the motor assembly 24. The grooves 92 of the hammer case 14 define a flange surface 100 that is configured to clamp the ring gear 68 against the front endbell 56 when the hammer case 14 is securely fastened to the tool housing 12.

In some prior art designs, the ring gear 68 is coupled directly to the front endbell 56. In the illustrative embodiment, the position of the ring gear 68 relative to the front endbell 56 is instead secured through the piloting features 90 of the hammer case 14. For example, the hammer case 14 is piloted by the front endbell 56, while the hammer case 14 pilots the ring gear 68. Such an embodiment reduces the number of parts of the tool 10 and may reduce the length of the tool 10 by removing connectors between the ring gear 68 and the front endbell 56.

Figure 9:
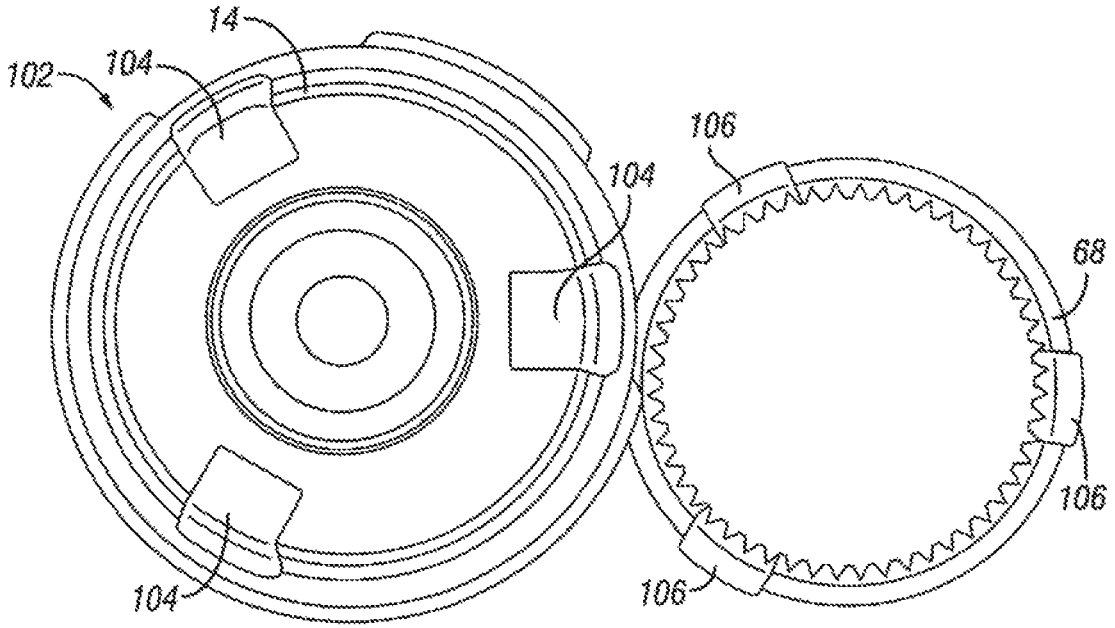
FIG. 9 is a top view of another embodiment of the hammer case and the ring gear that may be used with the power tool of FIG. 1.
Figure 10:
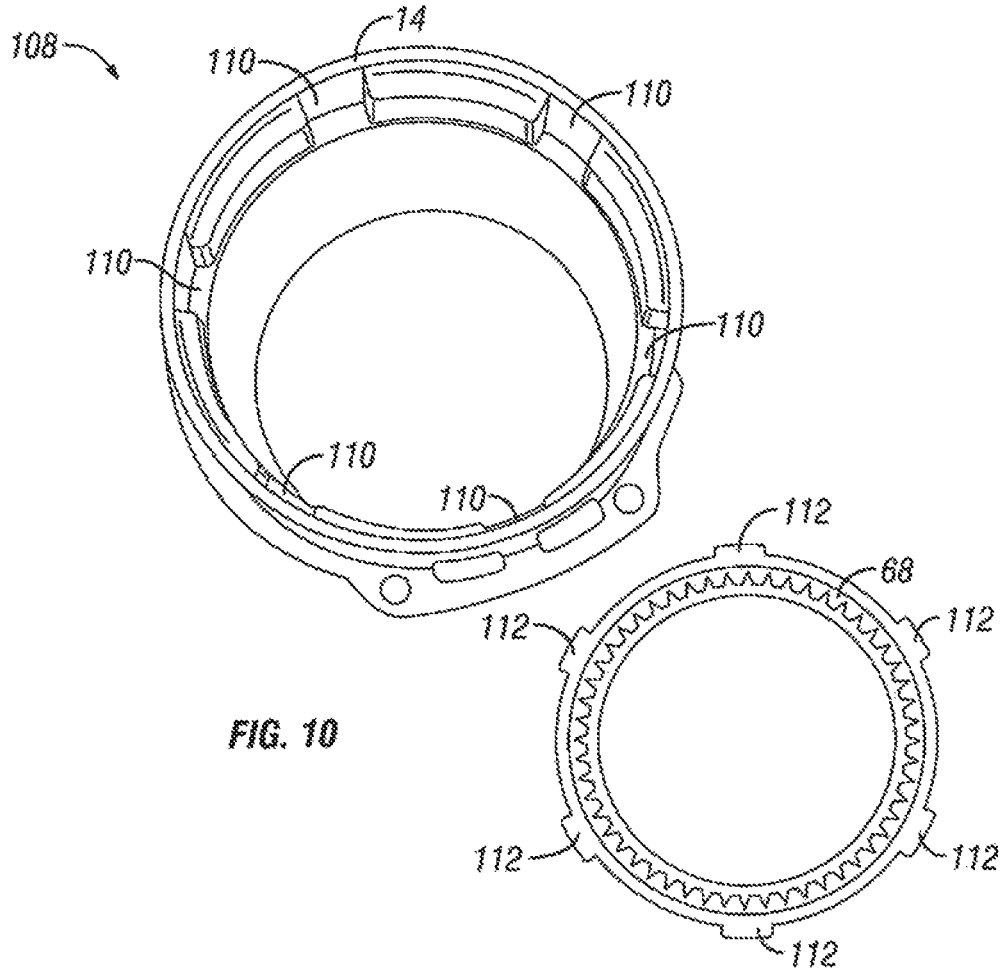
FIG. 10 is a top view of yet another embodiment of the hammer case and the ring gear that may be used with the power tool of FIG. 1.

As noted above, the piloting features 90 may include any number of grooves 92 and ridges 94, 96. For example, the illustrative piloting features 90 of FIGS. 7 and 8 include four grooves 92 spaced evenly around the inner surface 76 (see FIG. 6) of the hammer case 14, four corresponding ridges 94 spaced evenly around the outer surface 74 (see FIG. 6) of the ring gear 68, and four corresponding ridges 96 spaced evenly around the outer surface 98 of the front endbell 56. Each groove 92 is configured to mate with both a ridge 94 and a ridge 96. In another illustrative example, shown in FIG. 9, the piloting features 102 include three grooves 104 formed in the hammer case 14 with three corresponding ridges 106 formed in the ring gear 68 and three corresponding ridges in the front endbell 56 (not shown). In another illustrative example, shown in FIG. 10, the piloting features 108 include six grooves 110 formed in the hammer case 14 with six corresponding ridges 112 formed in the ring gear 68 and six corresponding ridges in the front endbell 56 (not shown).

While the piloting features 90, 102, 108 have been illustrated and described herein as including grooves 92, 104, 110 formed in the hammer case 14 and ridges 94, 96, 106, 112 formed on the ring gear 68 and front endbell 56, it is contemplated that the piloting features 90, 102, 108 may take other forms in other embodiments of the power tool 10. By way of illustrative example, the piloting features might alternatively include ridges formed on the hammer case 14 and corresponding grooves formed in the ring gear 68 and front endbell 56.

Figure 11:
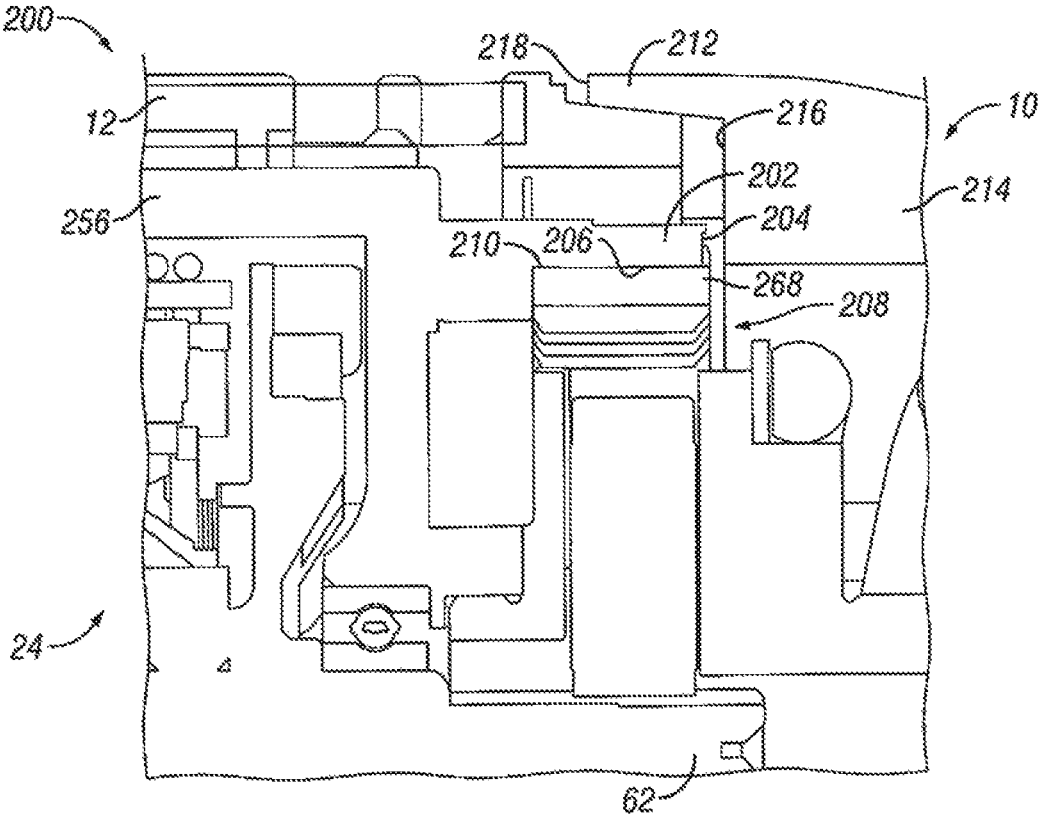
FIG. 11 is a cut-away side elevation view of still another embodiment of ring gear alignment features that may be used with the power tool of FIG. 1.

Referring to FIG. 11, another embodiment of alignment features 200 for a ring gear 268 of the power tool 10 is shown. In this illustrative embodiment, a front endbell 256 is configured to surround the ring gear 268, and thereby align and secure the ring gear 268 in relation to the motor assembly 24 of the power tool 10. Additionally, a hammer case 214 is configured to operatively couple to the tool housing 12, the front endbell 256, and the ring gear 268. The front endbell 256 includes an annular flange 202 formed in a front end 204 of the front endbell 256. The annular flange 202 includes an inner surface 206 that is configured to from a cavity 208 that is sized to receive a portion of the ring gear 268. The inner surface 206 operatively couples to an outer surface 210 of the ring gear 268 when the ring gear 268 is assembled in the power tool 10. The front endbell 256 is configured to secure the ring gear 268 and prevent the ring gear 268 from rotating during normal operation of the power tool 10.

In this embodiment of the alignment features 200, the hammer case 214 is configured to be secured to an outer surface 210 of the tool housing 12. The hammer case 214 includes a housing flange 212 and a gear assembly surface 216 formed in a motor end 218 of the hammer case 214. The housing flange 212 is configured to operatively couple to the outer surface 210 of the tool housing 12, and thereby secure the hammer case 214 to the tool housing 12. The gear assembly surface 216 is configured to abut the annular flange 202 of the front endbell 256 and the ring gear 268 of the gear assembly 54 (see, also, FIG. 5). By so doing, the hammer case 214 cooperates with the front endbell 256 to secure the ring gear 268 to the power tool 10.

Figure 12:
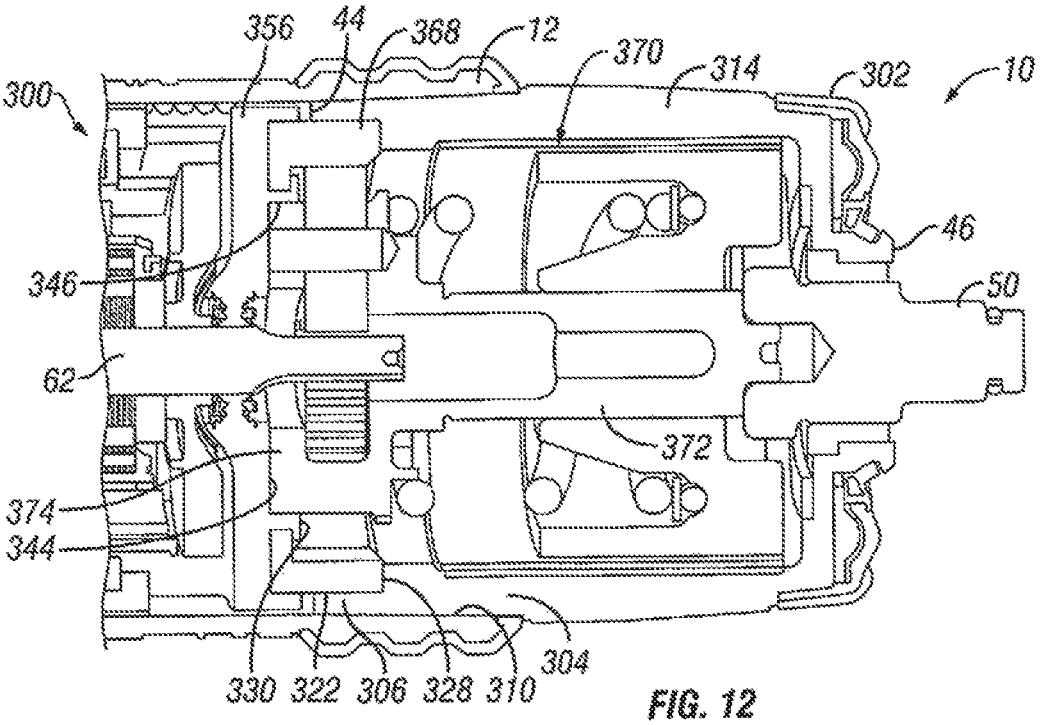
FIG. 12 is a cut-away side elevation view of yet another embodiment of ring gear alignment features that may be used with the power tool of FIG. 1.

Referring to FIG. 12, another embodiment of alignment features 300 for a ring gear 368 of a power tool 10 is shown. The ring gear alignment features 300 are configured to align the ring gear 368 with the motor assembly 24 (see FIG. 11) and allow the power tool 10 to function properly. In this embodiment of the alignment features 300, the ring gear 368 is insert molded to a front endbell 356 of the motor assembly 24.

Also shown in FIG. 12, a hammer case 314 is operatively coupled to the ring gear 368, the front endbell 356, and the tool housing 12 and is configured to seal the interior space 22 of the power tool 10. In the illustrative embodiment, the hammer case 314 includes a nose piece 302 attached to it. The hammer case 314 includes a tapered section 304 and a flange 306 formed in the tool end 44 of the hammer case 314. The tapered section 304 of the hammer case 314 is configured to operatively couple to an inner surface 310 of the tool housing 12. The flange 306 is configured to operatively couple to the outer surfaces 322, 328 of the ring gear 368.

Figure 13:
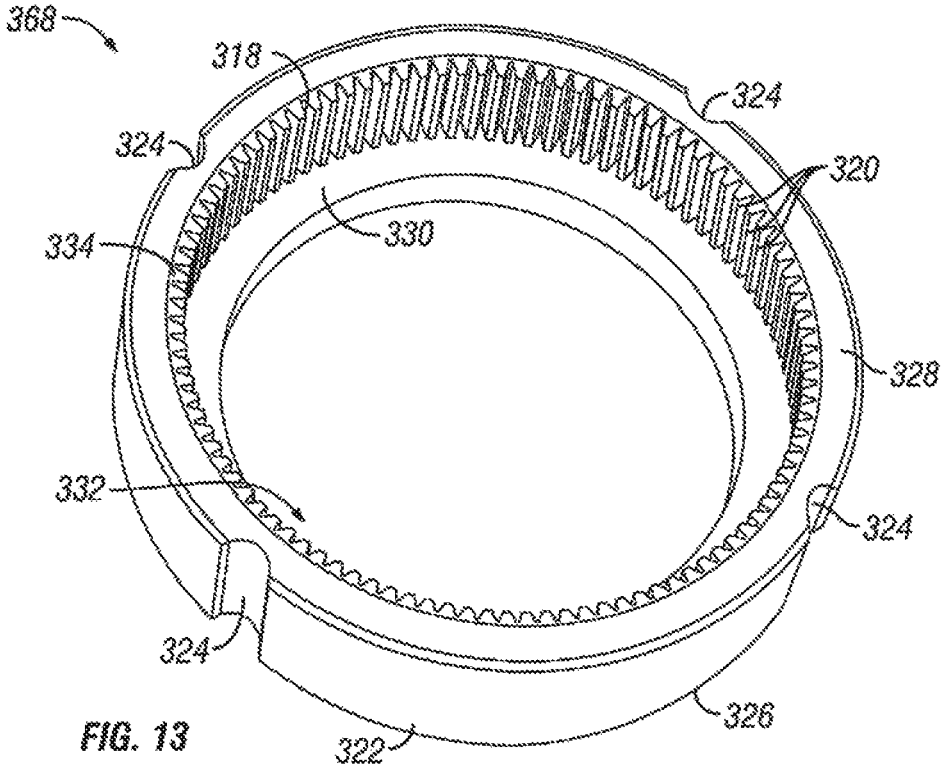
FIG. 13 is a top plan view of the ring gear shown in FIG. 12.

As shown in FIG. 13, the ring gear 368 is formed as an annular ring that includes an inner ring surface 318 having a plurality of teeth 320 formed therein and an outer surface 322 having one or more fastener guide bores 324 formed therein. The ring gear 368 extends between a motor end 326 and another opposite end. A lip 330 is formed in the motor end 326 of the ring gear 368 causing the motor end 326 to define a motor end opening 332 having a smaller diameter than an opposite end opening 334 defined in the opposite end of the ring gear 368. The lip 330 is configured to cooperate with the front endbell 356 to secure the ring gear 368 to the motor assembly 24 (see, also, FIGS. 11 and 12). In the illustrative embodiment the ring gear 368 is secured to the motor assembly 24 by insert molding the ring gear 368 directly into the front endbell 356.

Figure 14:
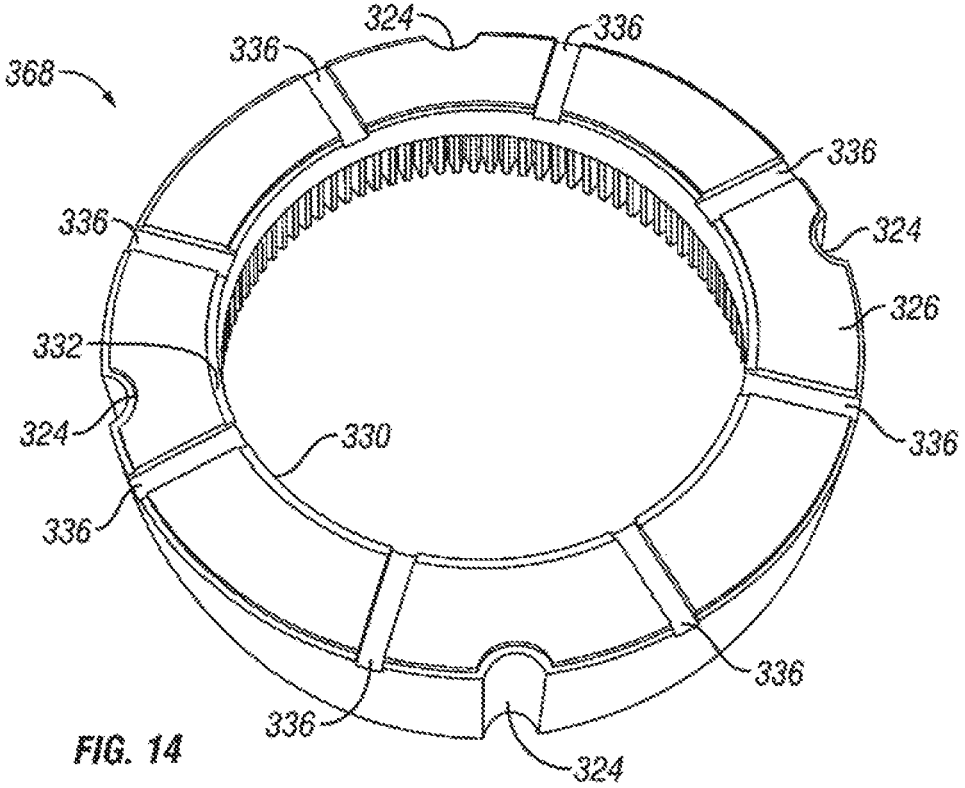
FIG. 14 is a bottom plan view of the ring gear shown in FIG. 12.

As shown in FIG. 14, one or more grooves 336 are formed in the motor end 326 of the ring gear 368 and are configured to secure ring gear 368 to the front endbell 356. During the insert molding process, hot plastic enters into the grooves 336. After the plastic cools, the grooves 336 cooperate with the plastic of the front endbell 356 to secure the ring gear 368 to the front endbell 356 such that the ring gear 368 cannot rotate relative to the front endbell 356. It is contemplated that, in other embodiments, the grooves 336 may be replaced by other raised or recessed features that cooperate with the front endbell 356 to secure the ring gear 368 against rotation relative to the front endbell 356.

Figure 15:
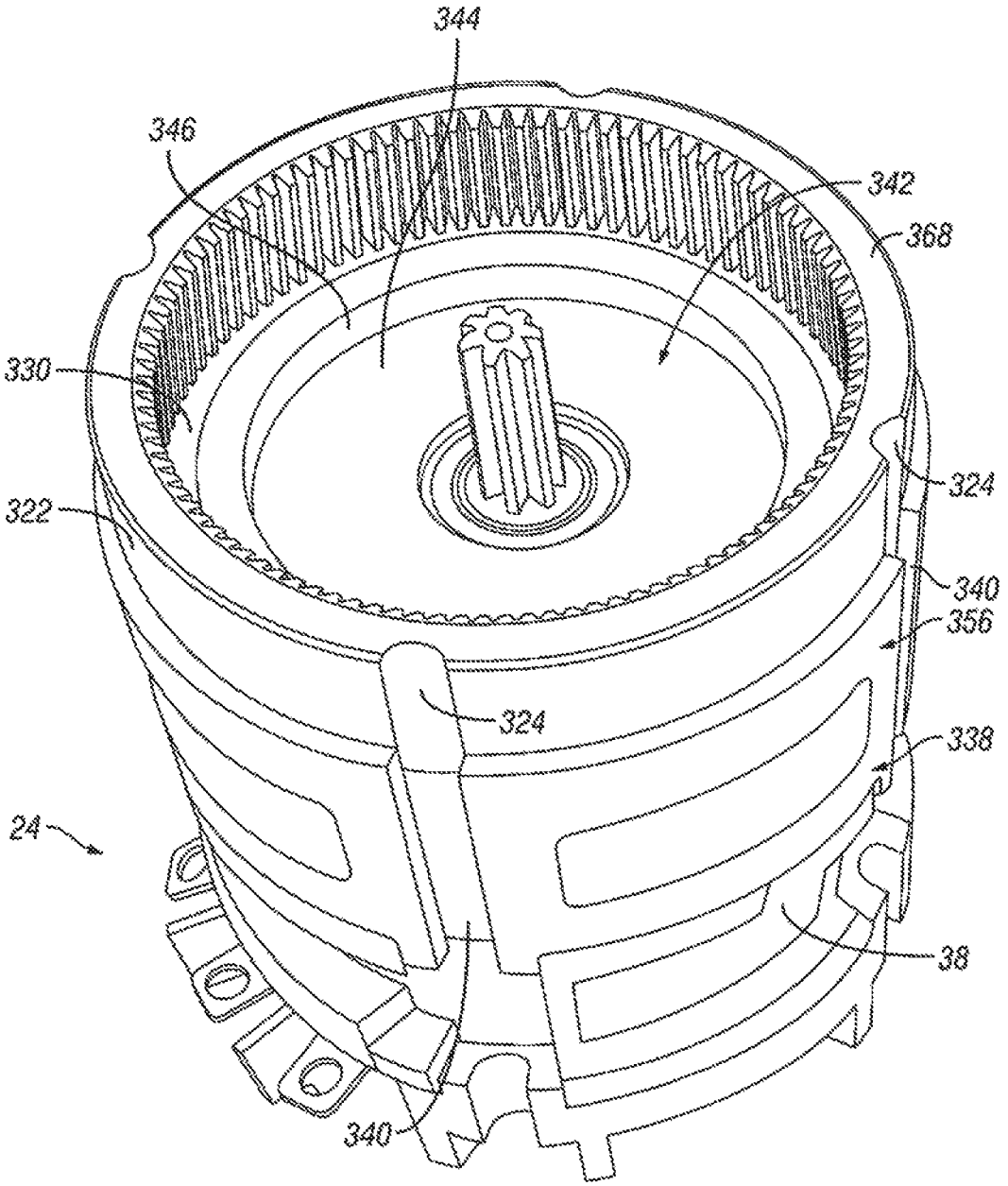
FIG. 15 is a perspective view of a motor assembly and the ring gear shown in FIG. 12.

As shown in FIG. 15, the front endbell 356 includes an outer body 338 sized to receive the ring gear 368. The outer body 338 is configured to operatively couple to the outer surface 322 of the ring gear 368 (see FIGS. 13 and 14). One or more fastener guide bores 340 are formed in the outer body 338. When assembled, the fastener guide bores 340 of the front endbell 356 are configured to align with the corresponding fastener guide bores 324 formed in the ring gear 368. The fastener guide bores 324, 340 cooperate with fasteners (not shown) to secure the motor assembly 24 and the gear assembly 54 in the tool housing 12. When the fastener guide bores 324, 340 are aligned, fasteners are able to pass through the motor assembly 24 and be received by the hammer case 314.

The front endbell 356 also includes an inner body 342 configured to interact with the lip 330 of the ring gear 368 and secure the ring gear 368 to the front endbell 356. During the insert molding process, the plastic of the front endbell 356 forms around the lip 330 thereby joining the ring gear 368 to the front endbell 356. In the illustrative embodiment, the insert molding process is accomplished by injecting thermoplastic into a mold in which the ring gear 368 has been placed. The thermoplastic eventually hardens and thereby forms the front endbell 356.

As best seen in FIGS. 12-15, the inner body 342 of the front endbell 356 is also configured to pilot a camshaft 372 of the impact mechanism 370 of the tool 10. As shown in FIG. 12, the camshaft 372 is integrally formed to include a planetary gear holder at a distal end 374 of the camshaft 372. The inner body 342 of the front endbell 356 is formed to include a recessed annular surface 344 that engages the distal end 374 of the camshaft 372 when the tool 10 is assembled. The inner body 342 of the front endbell 356 is also formed to include a wall 346 that extends away from the recessed annular surface 344 (the wall 346 also forming a part of the inner body 342 that engages and retains the lip 300 of the ring gear 368, as described above). As best seen in FIG. 12, when the tool 10 is assembled, an inner diameter of the wall 346 surrounds a portion of an outer diameter of the distal end 374 of the camshaft 372 such that the front endbell 356 pilots the camshaft 372. This configuration eliminates the need for a separate bearing and/or additional components to support the distal end 374 of the camshaft 372, thereby reducing the complexity and overall length of the tool 10.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A hand-held power tool comprising:

a housing supporting a motive source;

wherein the housing includes a front endbell having an outer body surface;

an output shaft protruding from an output end at the front endbell of the housing, the output shaft having an axis;

wherein the output shaft is coupled to the motive source such that the output shaft rotates in response to activation of the motive source when the motive source is supplied with power;

a front housing defining an interior space;

wherein the output shaft is located in the interior space of the front housing; and a gear set assembly located in the interior space of the front housing;

wherein the gear set assembly is configured to transfer rotation from the motive source to an output spindle;

wherein the gear set assembly includes a ring gear characterized by an annular ring body having a plurality of teeth located on the interior periphery of the annular ring body and a surface located on an exterior periphery of the annular ring body opposite the interior periphery;

wherein the ring gear surrounds a portion of the output shaft and abuts the front endbell of the housing;

wherein the front endbell includes a first guide bore disposed on the outer body surface, and the ring gear includes a second guide bore, the first guide bore and the second guide bore offset from the axis, wherein the ring gear is configured to be secured relative to the housing when the first guide bore is aligned with the second guide bore; and wherein the ring gear is insert molded into the front endbell of the housing such that ring gear is restrained against both axial and rotational movement relative to the front endbell.

2. The hand-held power tool of claim 1, wherein the front housing is coupled to the ring gear and the front endbell; and wherein the front housing includes a nose piece located adjacent the output spindle.

3. The hand-held power tool of claim 1, wherein the front housing includes a tapered section coupled to an inner surface of the housing.

4. The hand-held power tool of claim 1, wherein the front housing includes a flange coupled to the surface located on the exterior periphery of the annular ring body opposite the interior periphery thereof.

5. The hand-held power tool of claim 1, wherein the ring gear includes a lip formed at a first end of the ring gear;

wherein the first end of the ring gear is coupled to the front endbell; and wherein the lip defines a first opening of the ring gear having a first diameter.

6. The hand-held power tool of claim 5, wherein the ring gear includes a second opening defined at a second end of the ring gear opposite the first end of the ring gear; and wherein the second opening includes a second diameter that is greater than the first diameter.

7. The hand-held power tool of claim 5, wherein the front endbell includes an annular surface and a wall extending away from the annular surface; and wherein the wall of the front endbell contacts the lip of the ring gear to restrain the ring gear against axial movement.

8. The hand-held power tool of claim 7, further comprising:

a cam shaft that is coupled to the ring gear and the output spindle; and wherein the wall of the front endbell surrounds a portion of the camshaft such that the front endbell pilots the camshaft.

9. The hand-held power tool of claim 1, wherein the second guide bore is formed in the surface located on the exterior periphery of the annular ring body.

10. The hand-held power tool of claim 1, wherein the ring gear includes a first end coupled to the front endbell;

wherein the first end of the ring gear includes a first securement feature selected from the group consisting of: at least one raised structure and at least one recessed structure;

wherein the front endbell includes a second securement feature that is the other of: at least one raised structure and at least one recessed structure; and wherein the second securement feature contacts the first securement feature to restrain the ring gear against movement.

11. A method of manufacturing the hand-held power tool of claim 1, comprising:

providing a melted thermoplastic material to a mold in which the ring gear is positioned to form the front endbell;

coupling the housing to the front housing; and coupling the front housing to the ring gear.

12. The method of claim 11, further comprising:

arranging a portion of the melted thermoplastic material adjacent a lip formed at a first end of the ring gear to join the front endbell to the ring gear.

13. The method of claim 11, further comprising:

arranging a portion of the melted thermoplastic material to be in contact with a securement feature of the ring gear;

wherein the securement feature is selected from the group consisting of at least one raised structure and at least one recessed structure.

14. The method of claim 13, wherein the securement feature is defined at a first end of the ring gear positioned adjacent the motive source.

15. A method of manufacturing the hand-held power tool of claim 1, comprising:

providing a motive source, a housing configured to support the motive source and include a front endbell, an output spindle, and a gear set assembly configured to transfer rotation from the motive source to the output spindle; and inserting a melted thermoplastic material into a mold in which a ring gear of the gear set assembly is positioned to form the front endbell.

16. The method of claim 15, wherein inserting a melted thermoplastic material into a mold in which a ring gear of the gear set assembly is positioned to form the front endbell includes:

coupling the front endbell to the ring gear.

17. The method of claim 16, wherein coupling the front endbell to the ring gear includes restraining both axial and rotational movement of the ring gear relative to the front endbell.

18. The method of claim 15, wherein inserting a melted thermoplastic material into a mold in which a ring gear of the gear set assembly is positioned to form the front endbell includes:

arranging a portion of the melted thermoplastic material adjacent a lip formed on ring gear to join the front endbell to the ring gear.

19. The method of claim 15, wherein inserting a melted thermoplastic material into a mold in which a ring gear of the gear set assembly is positioned to form the front endbell includes:

arranging a portion of the melted thermoplastic material to be in contact with a securement feature of the ring gear;

wherein the securement feature is selected from the group consisting of at least one raised structure and at least one recessed structure.

* * * * *